US008012251B2

(12) United States Patent
Yakuwa

(10) Patent No.: US 8,012,251 B2
(45) Date of Patent: Sep. 6, 2011

(54) ELECTROLESS PLATING BATH AND METHOD FOR PRODUCING HIGH-TEMPERATURE APPARATUS MEMBER USING THE BATH

(75) Inventor: Hiroshi Yakuwa, Tokyo (JP)

(73) Assignee: Ebara Corporation, Tokyo (JP)

( * ) Notice: Subject to any disclaimer, the term of this patent is extended or adjusted under 35 U.S.C. 154(b) by 637 days.

(21) Appl. No.: 12/078,284

(22) Filed: Mar. 28, 2008

(65) Prior Publication Data

US 2008/0241406 A1 Oct. 2, 2008

(30) Foreign Application Priority Data

Mar. 29, 2007 (JP) ..... 2007-088430

(51) Int. Cl.
*C23C 18/34* (2006.01)

(52) U.S. Cl. ..... 106/1.22; 106/1.27

(58) Field of Classification Search ..... 106/1.22, 106/1.27

See application file for complete search history.

(56) References Cited

U.S. PATENT DOCUMENTS

| | | | | |
|---|---|---|---|---|
| 3,485,597 | A * | 12/1969 | Pearlstein | 428/649 |
| 4,152,164 | A * | 5/1979 | Gulla et al. | 106/1.27 |
| 7,134,182 | B2 * | 11/2006 | Chang et al. | 29/603.07 |
| 7,659,203 | B2 * | 2/2010 | Stewart et al. | 438/678 |
| 2003/0124263 | A1 * | 7/2003 | Ueno et al. | 427/404 |
| 2005/0189230 | A1 | 9/2005 | Narita et al. | |
| 2006/0278123 | A1 * | 12/2006 | Wirth | 106/1.22 |
| 2009/0294295 | A1 * | 12/2009 | Uchiyama | 205/127 |
| 2010/0006326 | A1 * | 1/2010 | Ueno et al. | 174/257 |

FOREIGN PATENT DOCUMENTS

| | | |
|---|---|---|
| EP | 1 715 081 | 10/2006 |
| JP | 4-297001 | 10/1992 |

OTHER PUBLICATIONS

Tetsuya Osaka et al., "Preparation of Electroless-Plated NiReP Alloy Films for a Thin Film Resistor", Denki Kagaku, vol. 60, No. 6, pp. 523-530, Feb. 1992.

Man Kim et al., "Formation and Analysis of High Resistivity Electroless NiReB Films Deposited from a Sodium Citrate Bath", Journal of the Electrochemical Society, vol. 148, No. 11, pp. C753-C757, Oct. 2001.

* cited by examiner

*Primary Examiner* — Helene Klemanski

(74) *Attorney, Agent, or Firm* — Wenderoth, Lind & Ponack, L.L.P.

(57) ABSTRACT

There is provided an electroless plating bath which makes it possible to form a diffusion barrier layer of a Re-based alloy, having a uniform thickness regardless of the shape and size of a workpiece, on the surface of a Ni-based alloy by a relatively simple method. The electroless plating bath for forming a Ni—Re—B alloy, containing not less than 50 at % of Re, on a substrate by electroless plating, has a pH of 6 to 8 and includes a metal supply source component containing Ni2+ and ReO4− at an equal equivalent in the range of 0.01 to 0.5 mol/L, a complexing agent component containing citric acid and at least one other organic acid, and a reducing agent component containing dimethylamine-borane.

3 Claims, 6 Drawing Sheets

ELECTROLESS PLATING BATH AND METHOD FOR PRODUCING HIGH-TEMPERATURE APPARATUS MEMBER USING THE BATH

BACKGROUND OF THE INVENTION

1. Field of the Invention

The present invention relates to a method for producing a high-temperature apparatus member which is used at high temperatures, such as an industrial gas turbine, a jet engine, a micro gas turbine, an engine, a heat exchanger or a combustor, and also to an electroless plating bath suited for use in the method.

2. Description of the Related Art

High-temperature apparatus members, such as an industrial gas turbine blade and a combustor, often have a surface coating in order to enhance the heat resistance and the corrosion resistance.

A Cr or Al diffusion treatment, thermal spraying of a high Ni-high Cr alloy, etc. are generally employed to form a protective film on a substrate (apparatus member) in order to enhance the corrosion resistance. However, when an apparatus member having such a protective film is used in an ultra-high temperature environment, such as at 800 to 1200° C., an element(s) which contributes to corrosion resistance will diffuse very fast and become highly reactive, and therefore the protective film cannot be maintained stably over a long period of time. In a strongly corrosive environment, e.g. containing Cl or S, because of the rapid consumption of the element(s) constituting the protective film, such as Cr or Al, the protective film cannot be maintained stably over a long period of time even at a relatively low temperature of 500 to 800° C. The unstableness of a protective film in an ultra-high temperature environment or a corrosive environment poses the significant problem of short apparatus life. At present, measures such as the use of a lowered operating temperature are taken to extend the life of an apparatus member at the sacrifice of the performance of the apparatus.

On the other hand, "diffusion barrier" coating has recently been proposed as a technique for extending the life of a heat-resistant coating layer. This coating technique is directed to suppression of interdiffusion of elements between a substrate and a coating layer so as to achieve long-term phase stability of the coating layer and the substrate.

For example, Japanese Patent No. 3857689 discloses that a Re-based alloy film is suited for use as a diffusion barrier. In particular, the patent document describes a method comprising coating the surface of a Ni-based alloy substrate, which may be used as a rotor blade or a stator vane of a gas turbine, with an alloy film-containing Re at a high concentration, carrying out Ni plating of the coated surface, and then carrying out heat treatment of the surface for diffusion of aluminum, thereby forming a Ni—Cr—Re ternary alloy film, containing Re in an amount of not less than 20 at % (atomic percentage), between the substrate and an aluminum diffusion layer.

In the disclosed method, the alloy film containing a high concentration of Re is coated onto the substrate surface by magnetron sputtering. While sputtering or physical vapor deposition has the merit of easy control of the thickness and composition of a coating film, such a method has the drawbacks of a) many restrictions on the size and shape of a substrate, b) the necessity of a large-scale apparatus and a complicated operation, c) the formation of a coating film having many defects and cracks, etc., and thus is not suitable for practical use.

It is therefore conceivable to form an alloy film containing Re at a high concentration by electroplating which has less such drawbacks. In the case of plating, it is necessary to carry out a thermal diffusion treatment for phase stabilization of a plated film. In order to ensure the high Re concentration (at least 20 at %) after the phase stabilization, at least 50 at % of Re is necessary upon the completion of plating. In this connection, the applicant has disclosed a technique which, with the use of electroplating, makes it possible to control the amount of Re in an alloy film up to 98 at % (Japanese Patent Laid-Open Publication No. 2003-277972).

In electroplating, the distribution of current density in a workpiece to be plated depends on the shape of the workpiece: Electric current concentrates in raised portions whereby the resulting plating film is thick in the raised portions, whereas less electric current flows to recessed portions whereby the resulting plating film is thin in the recessed portions. Accordingly, the thickness of a plating film becomes non-uniform in a member having a complicated shape, such as a combustor of a micro gas turbine or a gas turbine blade having many through-holes. A too-thick plating film may cause peel off of the film, while a too-thin plating film may lower the performance of the film as a diffusion barrier. To correct the problem, attempts have conventionally been made, such as devisal of electrode arrangement, the use of an auxiliary electrode, etc. Such approaches, however, necessitate repetition of trial and error, and involve considerable costs and time for application to a costly article having a unique shape.

It is therefore conceivable to employ electroless plating which less suffers from the non-uniformity of a plating film due to the shape of a workpiece to be plated. Electroless plating uses a plating bath containing a reducing agent as well as a metal ion to be plated, and effects plating of the metal through reduction of the metal ion with the reducing agent. The solution system must be one in which an oxidation-reduction reaction does not occur in the solution, but occurs only at the surface of a workpiece. Such a system, however, is not always available to every chemical species.

Japanese Patent Laid-Open Publication No. 4-297001 teaches plating of a Ni-47.7 at % Re-3.8 at % P alloy using a plating bath which uses sodium hypophosphite ($NaH_2PO_2$) as a reducing agent and citric acid as a complexing agent. However, the concentration of Re in the plating film is still insufficient. In addition, because of the use of sodium hypophosphite as a reducing agent, phosphorus (P) is taken into the plating film and the phosphorus can form a low-melting compound with other element(s). The disclosed method is thus not preferred for forming a heat-resistant coating.

SUMMARY OF THE INVENTION

The present invention has been made in view of the above situation in the background art. It is therefore an object of the present invention to provide an electroless plating bath which makes it possible to form a diffusion barrier layer of a Re-based alloy, having a uniform thickness regardless of the shape and size of a workpiece, on the surface of a Ni-based alloy by a relatively simple method, and to provide a method for producing a high-temperature apparatus member using the electroless plating bath.

In order to achieve the object, according to a first aspect of the present invention, there is provided an electroless plating bath for forming a Ni—Re—B alloy, containing not less than 50 at % of Re, on a substrate by electroless plating, the bath having a pH of 6 to 8 and comprising a metal supply source component containing $Ni^{2+}$ and $ReO_4^-$ at an equal equivalent in the range of 0.01 to 0.5 mol/L, a complexing agent component containing citric acid and at least one other organic acid, the molar concentration ratio of citric acid to the sum of $Ni^{2+}$ and $ReO_4^-$ being 1/20 to 1/5 and the molar concentration ratio of the total organic acid of the citric acid and the at least one other organic acid to the sum of $Ni^{2+}$ and $ReO_4^-$ being 1/2 to 10, and a reducing agent component containing dimethylamine-borane, the molar concentration ratio of dimethylamine-borane to the sum of $Ni^{2+}$ and $ReO4^-$ *being* 1/4 to 2. The expression "equal equivalent" herein includes an allowable range of ±10%.

The at least one other organic acid may be an organic acid having a weaker complexing power for Re than citric acid. Examples of such an organic acid include succinic acid, malic acid, lactic acid and glycine.

The present plating bath has the following features:

a) Not sodium hypophosphite but dimethylamine-borane is used as a reducing agent so that the resulting film does not contain P.

b) Ni and Re are used at an equal equivalent with a view to increasing the deposition amount of Re by co-deposition of the metal components.

c) In consideration of the fact that because of the very strong complexing power of citric acid for Re, the use of citric acid in a large amount may adversely affect co-deposition of Ni and Re, the amount of citric acid used is decreased and an organic acid having a weaker complexing power for Re is used instead.

According to a second aspect of the present invention, there is provided a method for producing a high-temperature apparatus member, comprising the steps of: carrying out electroless plating on a substrate of a Ni-based alloy at 60 to 80° C. by using the above-described electroless plating bath to form a film of a Ni-(50-60) at % Re—B alloy on the substrate; and carrying out heat treatment at a temperature of not less than 700° C. to form a diffusion barrier layer of a Ni-(20-50) at % Re-(10-40) at % Cr-(0.1-10) at % B alloy in the substrate surface.

A diffusion barrier layer having a high diffusion prevention function can thus be formed by the simple method that involves electroless plating.

According to a third aspect of the present invention, there is provided a method for producing a high-temperature apparatus member, comprising the steps of: carrying out electroless plating on a substrate of a Ni-based alloy by using the above-described electroless plating bath to form a Re-containing film of a Ni-(50-60) at % Re—B alloy on the substrate; forming an outermost film composed of at least one layer of a Ni-based alloy on the Re-containing film; and carrying out aluminum diffusion heat treatment at a temperature of not less than 700° C. to form a diffusion barrier layer of a Ni-(20-50) at % Re-(10-40) at % Cr-(0.1-10) at % B alloy, lying in the vicinity of the substrate, and an aluminum-diffused corrosion-resistant layer lying on the outer side of the diffusion barrier layer.

According to a fourth aspect of the present invention, there is provided a method for producing a high-temperature apparatus member, comprising the steps of: carrying out electroless plating on a substrate of a Ni-based alloy by using the above-described electroless plating bath to form a Re-containing film of a Ni-(50-60) at % Re—B alloy on the substrate; forming a W-containing film, which serves as a W supply source, before or after the step of forming the Re-containing film; forming an outermost film composed of at least one layer of a Ni-based alloy after the formation of the Re-containing film and the W-containing film; and carrying out aluminum diffusion heat treatment at a temperature of not less than 700° C. to form a diffusion barrier layer of a Ni-(20-50) at % Re-(10-40) at % Cr-(5-10) at % W-(0.1-10) at % B alloy, lying in the vicinity of the substrate, and an aluminum-diffused corrosion-resistant layer lying on the outer side of the diffusion barrier layer.

In a preferred embodiment of the present invention, the W-containing film is a film of Ni-(10-15) at % W-(0.1-10) at % B and is formed by carrying out electroless plating using a Na-containing bath containing 0.03 to 0.2 mol/L of $Ni^{2+}$, 0.03 to 0.4 mol/L of $WO_4^{2-}$, 0.03 to 0.4 mol/L of citric acid or sodium citrate and 0.03 to 0.4 mol/L of dimethylamine-borane, the pH of the Na-containing bath being adjusted to 6 to 8 with sodium hydroxide.

Any of the above methods may further comprise the step of supplying a Cr source to the Re-containing film, according to necessity.

According to the present invention, a diffusion barrier layer of a Re-based alloy, having a uniform thickness regardless of the shape and size of a workpiece, can be formed on the surface of a Ni-based alloy by the relatively simple method.

DETAILED DESCRIPTION OF THE PREFERRED EMBODIMENTS

Preferred embodiments of the present invention will now be described in detail with reference to the drawings.

Figure 1:
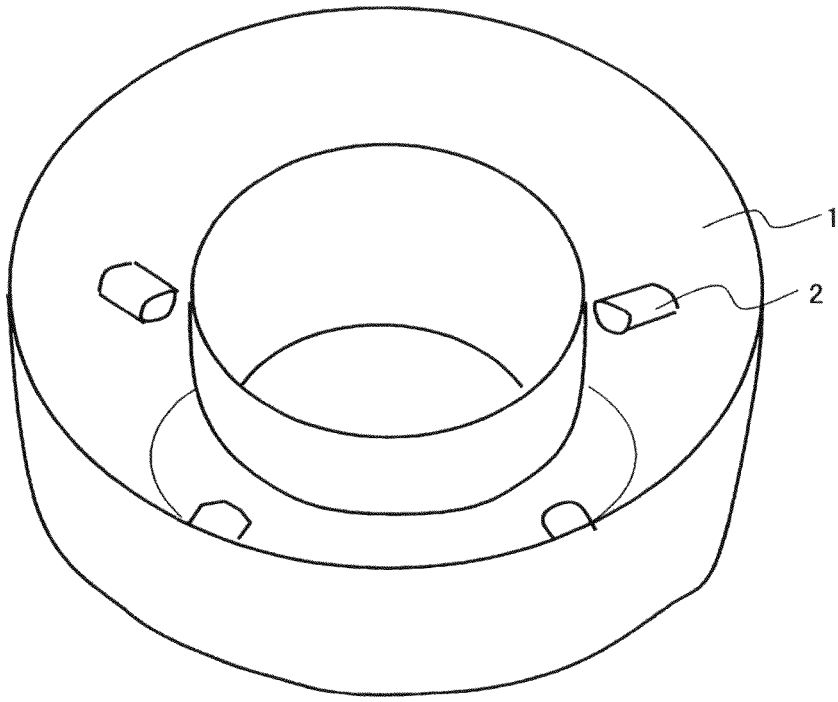
FIG. 1 is a perspective view of fuel injection nozzles of a combustor of a micro gas turbine, to which the present invention can be applied.
Figure 2:
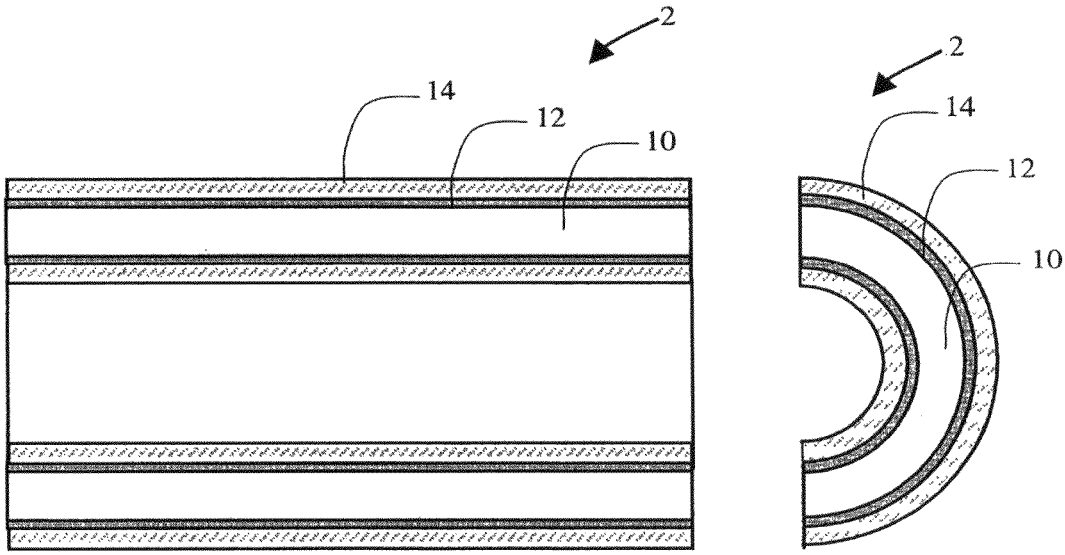
FIG. 2 is a cross-sectional view of the fuel injection nozzle of FIG. 1.

FIG. 1 shows fuel injection nozzles 2 of a combustor liner 1 of a micro gas turbine, to which the present invention can be advantageously applied. These nozzles project from the inner surface of the combustor liner. As schematically shown in FIG. 2 illustrating the cross-section of the nozzle 2, the fuel injection nozzle 2 is comprised of a pipe-shaped substrate 10 of a Ni-based alloy, diffusion barrier layers 12 of e.g. Ni-25 at % Re-20 at % Cr-8 at % W-1 at % B alloy, for example having a thickness of about 7 μm, formed on the inner and outer surfaces of the substrate 10, and aluminum-diffused corrosion-resistant layers 14 of e.g. a Ni—Al(B) alloy, for example having a thickness of about 20 μm, formed on the surfaces of the diffusion barrier layers 12.

Figure 3:
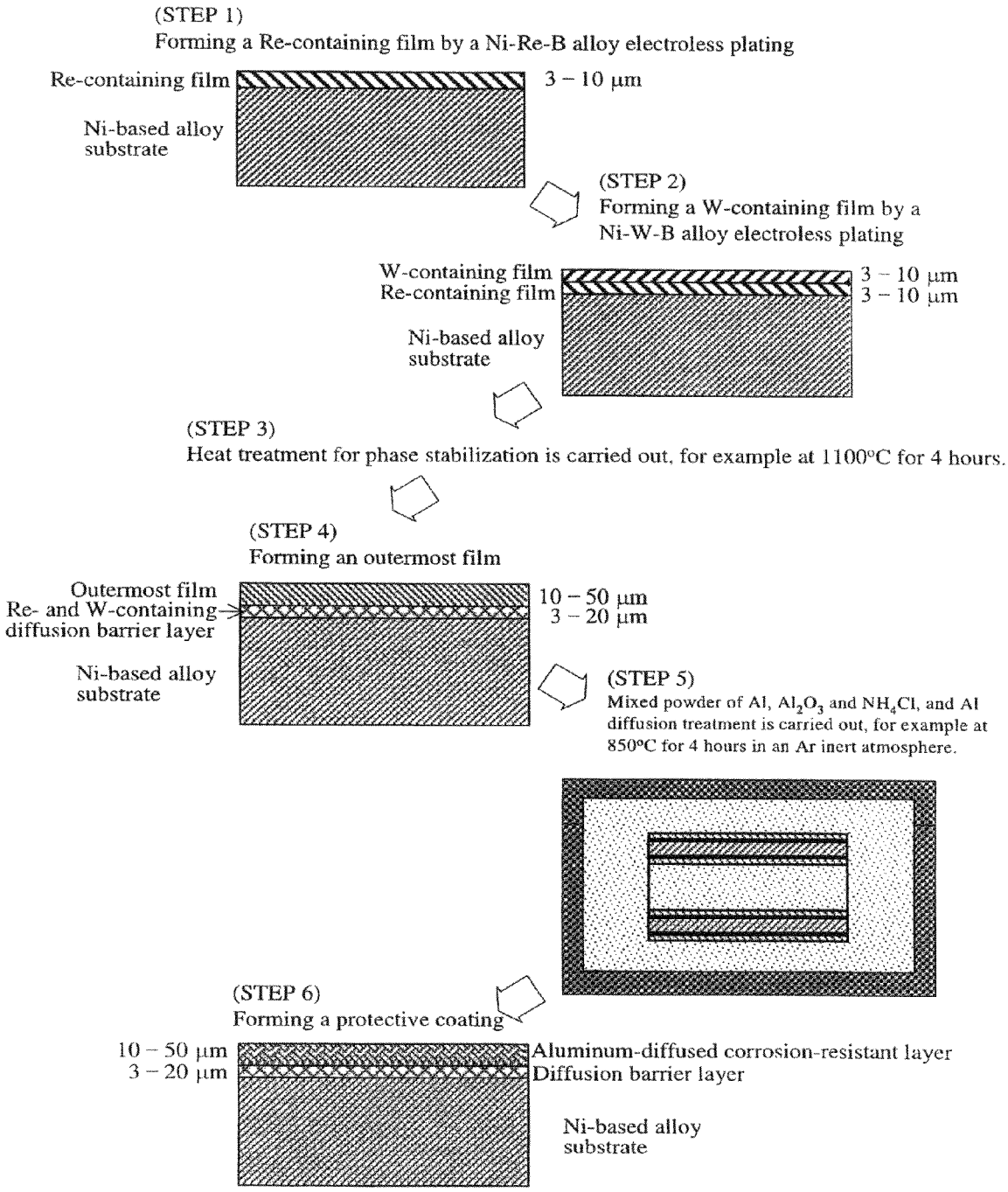
FIG. 3 is a diagram illustrating an embodiment of the method for producing a high-temperature apparatus member according to the present invention.

A method for producing such a fuel injection nozzle will now be described with reference to FIG. 3. First, electroless plating is carried out on the surface of the substrate to form a Re-containing film of a Ni—Re—B alloy (step 1). The Re content in the film is desirably not less than 50 at % when the intended Re content in a diffusion barrier layer is not less than 20 at %. The thickness of the Re-containing film is generally 3 to 10 μm, preferably 5 to 8 μm. The Re-containing film becomes a diffusion barrier layer after heat treatment of the film. If the thickness of the Re-containing film is less than 3 μm, the diffusion prevention performance of the diffusion barrier layer may be insufficient. If the thickness of the Re-containing film exceeds 10 μm, on the other hand, cracks are likely to be produced in the diffusion barrier layer. Thus, from the viewpoint of practical use, the use of such a thick Re-containing film is not preferred. A diffusion barrier layer having good diffusion prevention performance and crack resistance can be obtained when the thickness of the Re-containing film is 5 to 8 μm.

Next, electroless plating is carried out on the Re-containing film to form a W-containing film of a Ni—W—B alloy containing 10 to 15 at % of W (step 2). The thickness of the W-containing film is generally 3 to 10 μm, preferably 5 to 8 μm. Thereafter, heat treatment for phase stabilization is carried out, for example at 1100° C. for 4 hours (step 3), and then conventional Ni—B plating is carried to form an outermost film generally having a thickness of 10 to 50 μm, preferably 15 to 30 μm (step 4). Thereafter, the nozzle substrate with the films formed thereon is placed in a treatment vessel and covered with a mixed powder of Al, $Al_2O_3$ and $NH_4Cl$, and Al diffusion treatment is carried out, for example at 850° C. for 4 hours in an Ar inert atmosphere (step 5), thereby producing a nozzle having a diffusion barrier layer and an aluminum-diffused corrosion-resistant layer formed on the substrate (step 6). The thicknesses of the diffusion barrier layer and the aluminum-diffused corrosion-resistant layer thus formed are equal between the inner and outer surfaces of the fuel injection nozzle.

An electroless plating bath used for the formation of the Re-containing film has a pH of 6 to 8 and comprises a metal supply source component containing $Ni^{2+}$ and $ReO_4^-$ at an equal equivalent in the range of 0.01 to 0.5 mol/L, a complexing agent component containing citric acid and at least one other organic acid, the molar concentration ratio of citric acid to the sum of $Ni^{2+}$ and $ReO_4^-$ being 1/20 to 1/5 and the molar concentration ratio of the total organic acid of the citric acid and the at least one other organic acid to the sum of $Ni^{2+}$ and $ReO_4^-$ being 1/2 to 10, and a reducing agent component containing dimethylamine-borane, the molar concentration ratio of dimethylamine-borane to the sum of $Ni^{2+}$ and $ReO_4^-$ being 1/4 to 2. An electroless plating bath used for the formation of the W-containing film contains 0.03 to 0.2 mol/L of $Ni^{2+}$, 0.03 to 0.4 mol/L of $WO_4^{2-}$, 0.03 to 0.4 mol/L of citric acid or sodium citrate and 0.03 to 0.4 mol/L of dimethylamine-borane, the pH of the bath being adjusted to 6 to 8 with sodium hydroxide.

An electroless plating method for the formation of a Re-containing film will be described below in detail.

The composition of the electroless plating bath of the present invention is shown in Table 1 together with the composition of the electroless plating bath described in the above-cited Japanese Patent laid-Open Publication No. 4-297001 (patent document) for comparison.

TABLE 1

| Bath composition* | | | Present invention | Preferred composition | Patent document |
|---|---|---|---|---|---|
| Essential component | Reducing agent | Dimethylamine-borane | ¼ - twice (Re + Ni) | ½ - equal to (Re + Ni) | 0.1 $NaH_2PO_2 \cdot H_2O$ |
| | Ni supply source | $NiSO_4$ | 0.01-0.5, equal to Re | 0.03-0.1 | 0.075 |
| | Re supply source | $NH_4ReO_4$ | 0.01-0.5, equal to Ni | 0.03-0.1 | 0.03 |
| | Complexing agent | Citric acid | 1/20-1/5 of (Re + Ni) | 1/10 of (Re + Ni) | 0.4 |
| At least one organic acid needed | (organic acid) | Succinic acid<br>Malic acid<br>Glycine<br>Lactic acid | Total organic acid of citric acid and these organic acids:<br>½-10 of (Re + Ni) | Total organic acid of citric acid and these organic acids:<br>1-2 of (Re + Ni) | |
| pH buffering agent | | $Na_2B_4O_7$ | Possible to 0.5 | 0.05-0.15 | |
| | | $H_3BO_3$ | Possible to 0.5 | 0.05-0.15 | 0.05 |
| Bath stabilizer | | $Pb(NO_3)_2$ | Possible to 10 g/L | 1-3 g/L | 2 g/L |
| pH | | $NH_4OH$ or $(CH_3)_4NOH$ | 6-8 | 6.5-7 | 6.0 (with NaOH) |
| Bath temp. (° C.) | | | 60-80 | 65-75 | 90 |

*Unit for bath composition: mol/L unless otherwise specified

The electroless plating bath of the present invention has the following features:

a) Not sodium hypophosphite but dimethylamine-borane is used as a reducing agent so that the resulting film does not contain P.

b) Ni and Re are used at an equal equivalent with a view to increasing the deposition amount of Re by co-deposition of the metal components.

c) In consideration of the fact that because of the very strong complexing power of citric acid for Re, the use of citric acid in a large amount may adversely affect co-deposition of Ni and Re, the amount of citric acid used is decreased and an organic acid having a weaker complexing power for Re is used instead.

EXPERIMENTAL EXAMPLES

The following Examples and Comparative Examples illustrate the formation of a Re-containing film on the substrate of Ni-based alloy, using electroless plating baths according to the present invention or comparative plating baths. As shown in Table 2, in Examples 1 to 3, the concentrations of Ni and Re are varied in the range of 0.05 to 0.1 mol/L, and the molar concentration ratio of citric acid to the sum of Ni and Re (hereinafter referred to as "citric acid ratio") is made 1/10. In Comparative Example 1, the amount (molar concentration) of Ni is made 1/10 of the amount of Re, and the citric acid ratio is made 1/5.5. Comparative Example 2 uses only citric acid as a complexing agent with the citric acid ratio of 1. In Comparative Example 4, the citric acid ratio is made 1/4. The composition of Comparative Example 5 corresponds to the composition just changed the reducing agent from sodium hypophosphite to dimethylamine-borane disclosed in the above-cited Japanese Patent laid-Open Publication No. 4-297001, using the citric acid ratio of 4 and a high bath temperature of 90° C.

The compositions of plating films, which had been formed on the substrates of Ni-based alloy using the electroless plating baths of the Examples and Comp. Examples, were determined by EPMA (electron probe X-ray microanalysis) of cross sections of the respective samples. The results are shown in Table 2.

TABLE 2

| Bath composition* | Example 1 | Example 2 | Example 3 | Comp. Ex. 1 | Comp. Ex. 2 | Comp. Ex. 3 | Comp. Ex. 4 | Comp. Ex. 5 |
|---|---|---|---|---|---|---|---|---|
| Dimethylamine-borane | 0.05 | 0.1 | 0.1 | 0.05 | 0.05 | 0.05 | 0.05 | 0.05 |
| $NiSO_4$ | 0.05 | 0.075 | 0.1 | 0.005 | 0.05 | 0.05 | 0.05 | 0.075 |
| $NH_4ReO_4$ | 0.05 | 0.075 | 0.1 | 0.05 | 0.05 | 0.05 | 0.05 | 0.03 |
| Citric acid | 0.01 | 0.015 | 0.02 | 0.01 | 0.1 | 0.05 | 0.025 | 0.4 |
| Succinic acid | 0.03 | 0.03 | 0.06 | 0.03 | | 0.03 | 0.03 | |
| Malic acid | 0.03 | 0.03 | 0.06 | 0.03 | | | | |
| Glycine | | 0.01 | 0.02 | | | 0.01 | 0.01 | |
| Lactic acid | 0.03 | 0.03 | 0.06 | 0.03 | | 0.03 | 0.03 | |
| $Na_2B_4O_7$ | | 0.05 | | 0.05 | | | | |
| $H_3BO_3$ | 0.05 | | 0.1 | | 0.05 | 0.05 | 0.05 | 0.05 |
| $Pb(NO_3)_2$ (g/L) | 1 g/L | 1.5 g/L | 2 g/L | 1.5 g/L | 2 g/L | 2 g/L | 2 g/L | 2 g/L |
| pH** | 6.5 | 6.5 | 7*** | 6.5 | 6.5 | 6.5 | 6.5 | 9 |
| Bath temp. (° C.) | 75 | 70 | 75 | 75 | 70 | 75 | 75 | 90 |
| Film composition (at %) | Ni—58Re—5B | Ni—54Re—5B | Ni—51Re—7B | No deposition | Ni—5B | Ni—5B | Ni—25Re—5B | Ni—29Re—7B |

*Unit for bath composition: mol/L unless otherwise specified pH is adjusted with $NH_4OH$ (* pH is adjusted with $(CH_3)_4NOH$ in Example 3)

As shown in Table 2, the plating films obtained in Examples 1 to 3 all contained more than 50 at % of Re. On the other hand, no deposition occurred in Comp. Example 1; films containing no Re were formed in Comp. Examples 2 and 3; a film containing 25 at % of Re was formed in Comp. Example 4; and a film containing 29 at % of Re was formed in Comp. Example 5. A considerable decrease in the amount of the bath was observed in Comp. Example 5 due to the high bath temperature.

Next, using the plating bath of Example 1, the substrate was subjected to the process described above with reference to FIG. 3 under the following conditions, thereby obtaining a final product (Product Example 1).

(Step 1) 10 μm-thick Ni—Re—B plating with the Ni—Re—B plating bath of Example 1

Figure 4:
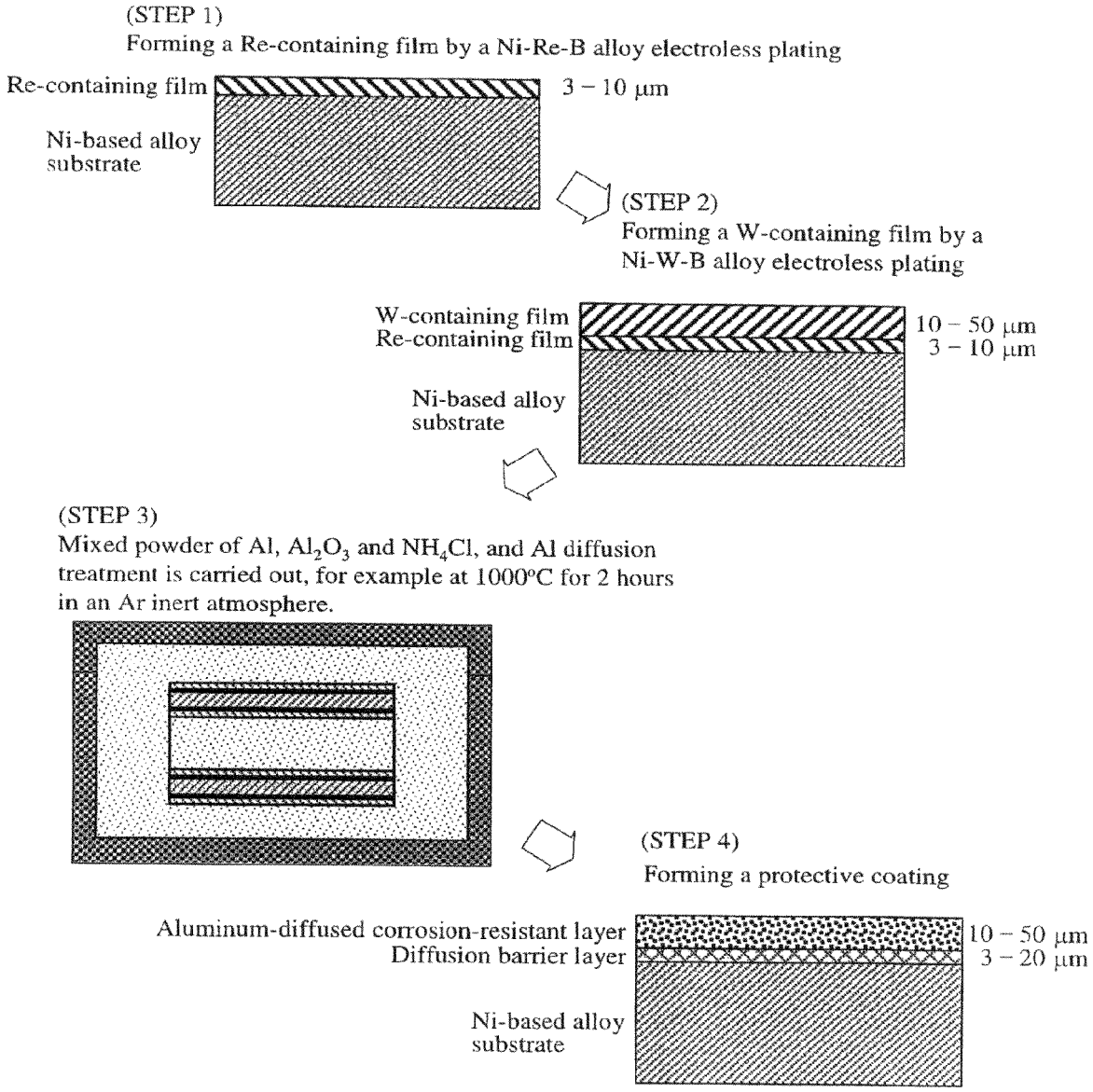
FIG. 4 is a diagram illustrating another embodiment of the method for producing a high-temperature apparatus member according to the present invention.

(Step 2) 8 μm-thick Ni-12 at % W—B plating (Step 3) Heat treatment in vacuum at 1100° C. for 4 hrs (Step 4) 30 μm-thick Ni—B plating (Step 5) Al diffusion treatment at 850° C. for 4 hrs in mixed power of Al, $Al_2O_3$ and $NH_4Cl$ Separately, using the plating bath of Example 1, the substrate was subjected to the process illustrated in FIG. 4 under the following conditions, thereby obtaining a final product (Product Example 2). With respect to the process of FIG. 4, the step 2 (the formation of W-containing film whose thickness is 10 to 50 μm) and the step 4 (the formation of the outermost film) of the process of FIG. 3 are integrated, whereby the step 3 (heat treatment for phase stabilization) and the step 4 are deleted.

(Step 1) 8 μm-thick Ni—Re—B plating with the Ni—Re—B plating bath of Example 1

Figure 5:
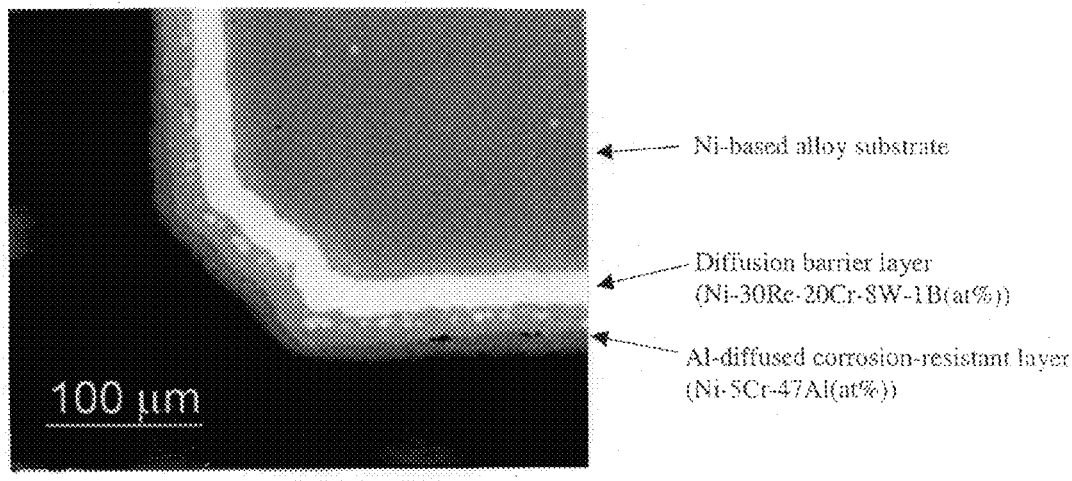
FIG. 5 is an SEM photograph of a cross section of Product Example 1.
Figure 6:
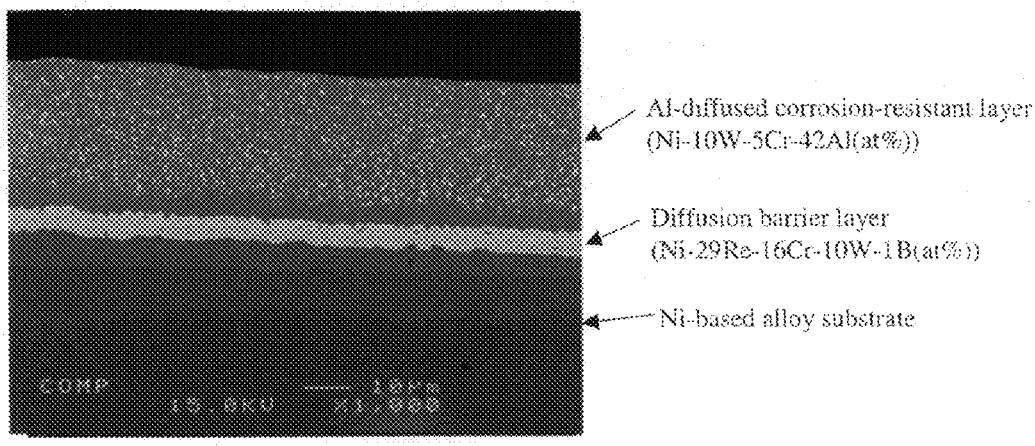
FIG. 6 is an SEM photograph of a cross section of Product Example 2.

(Step 2) 30 μm-thick Ni-12 at % W—B plating (Step 3) Al diffusion treatment at 1000° C. for 2 hrs in mixed power of Al, $Al_2O_3$ and $NH_4Cl$ FIGS. 5 and 6 show SEM (Scanning electron microscope) photographs of cross sections of Product Example 1 and Product Example 2, respectively. As can be seen from the Figures, the both products have a diffusion barrier layer and an Al-diffused corrosion-resistant layer, each having a uniform thickness. Further, as will be appreciated from FIG. 5, the uniformity of the layers was maintained even at the corner portions of the products. The compositions of the respective layers are shown in Table 3 below.

Figure 7:
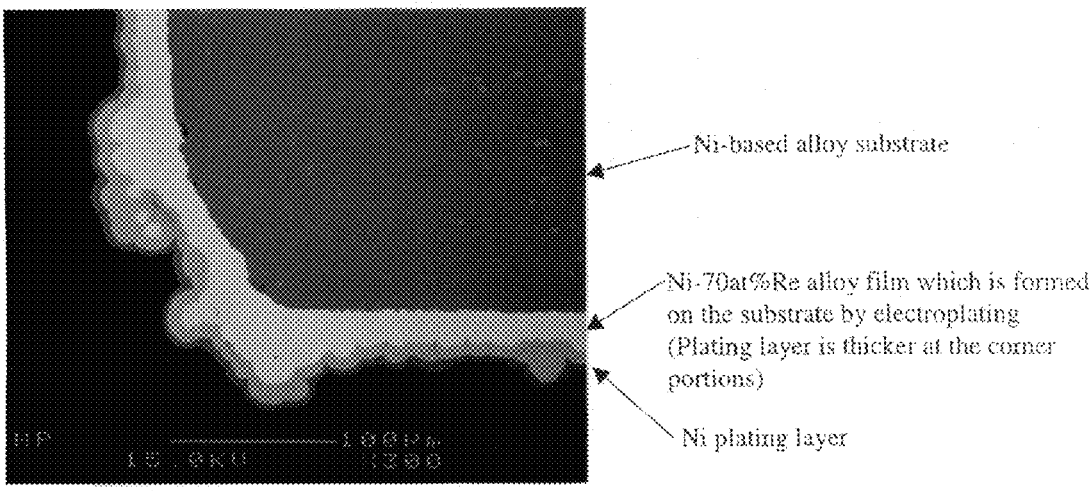
FIG. 7 is an SEM photograph of a cross section of a comparative product.
Figure 8:
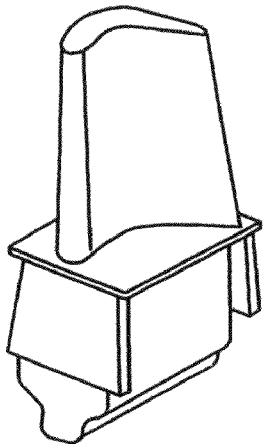
FIG. 8 is a perspective view of a rotor blade of a gas turbine, to which the present invention can be applied.
Figure 9:
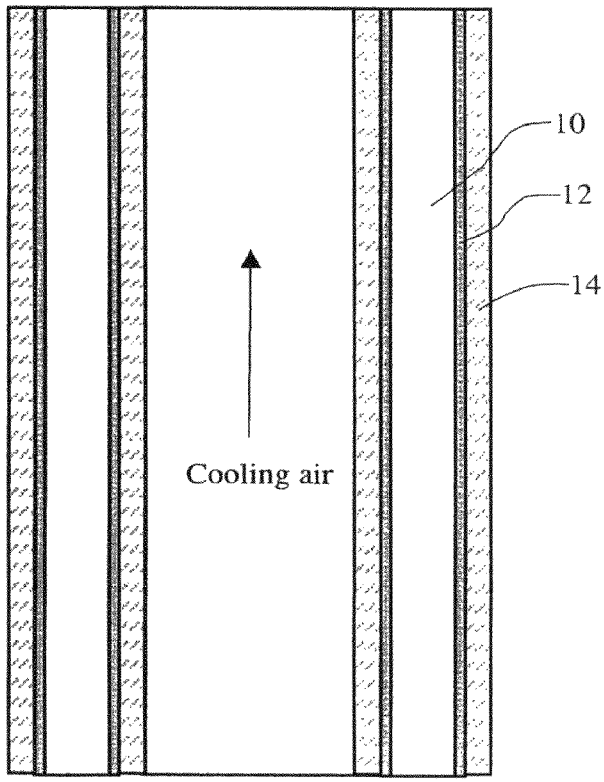
FIG. 9 is a cross-sectional view of the rotor blade of FIG. 8.
Figure 10:
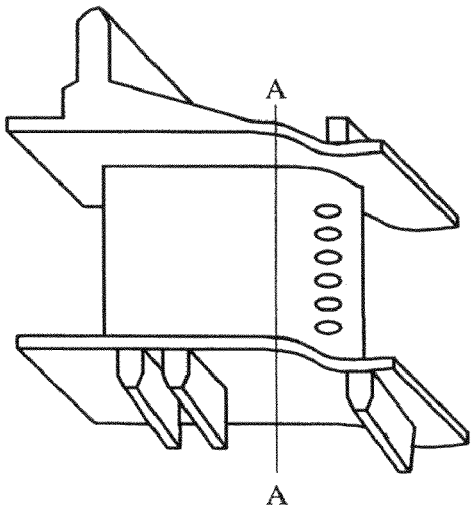
FIG. 10 is a perspective view of a stator vane of a gas turbine, to which the present invention can be applied.
Figure 11:
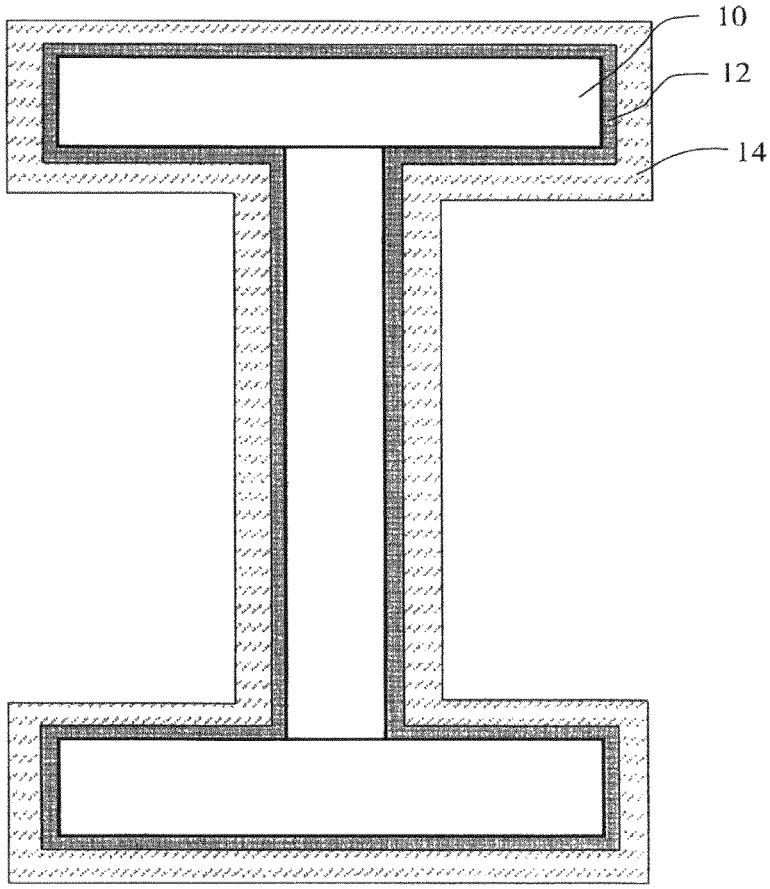
FIG. 11 is a cross-sectional view of the rotor blade of FIG. 10 taken along the line A-A.

FIG. 7 shows an SEM photograph of a cross section of a comparative product. The comparative product has a Ni-70 at % Re alloy film which was formed on the substrate by electroplating and a Ni plating layer which was formed on the Ni-70 at % Re alloy film by Ni electroplating. As can be seen from FIG. 7, the plating layer was thicker at the corner portions.

TABLE 3

| | Product Example 1 | Product Example 2 |
|---|---|---|
| Diffusion barrier layer | Ni—30Re—20Cr—8W—1B | Ni—29Re—16Cr—10W—1B |
| Al-diffused corrosion-resistant layer | Ni—5Cr—47Al | Ni—10W—5Cr—42Al |

Unit: at %

While the present invention has been described with reference to the embodiments thereof, the invention is not limited thereto. In particular, the processes for the formation of the respective layers, including heat treatment, illustrated in FIGS. 3 and 4 are in no way limiting, as described below. The present inventive method for the formation of a diffusion barrier layer and an Al-diffused corrosion-resistant layer may include some or all of the following process elements:

(Process element 1) Supply of Re: electroless plating with Ni—Re—B plating bath (thickness: 3-10 μm, preferably 5-8 μm)

(Process element 2) Supply of W: electroless plating with Ni—W—B plating bath (thickness: 3-10 μm, preferably 5-8 μm)

(Process element 3) Supply of Cr (a) Diffusion of Cr from alloy base (heat treatment in an inert or reducing gas: 700-1300° C., 1-10 h; preferably 1000-1200° C., 2-4 h)

(b) Cr vapor diffusion treatment (700-1300° C., 1-10 h; preferably 1000-1200° C., 2-4 h)

(Process element 4) Supply of Ni: electroless Ni—B plating (thickness: 10-50 μm, preferably 15-30 μm)

(Process element 5) Supply of Al: Al vapor diffusion treatment (700-1300° C., 1-10 h; preferably 900-1000° C., 2-4 h)

The object of the present invention can be achieved by appropriately combining the above process elements.

For example, a diffusion barrier layer and an Al-diffused corrosion-resistant layer can be formed by any one of the following methods:

Process 1: (1) →(2) →(3)-(a) →(4) →(5)
Process 2: (1) →(2) →(3)-(b) →(4) →(5)
Process 3: (1) →(2) →(4) →(5)
Process 4: (1) →(3)-(b) →(4) →(5)
Process 5: (1) →(4) →(5)
Process 6: (1) →(2) →(5)
Process 7: (2) →(1) →(3)-(a) →(4) →(5)
Process 8: (2) →(1) →(3)-(b) →(4) →(5)
Process 9: (2) →(1) →(4)→ (5)

Thus, it is enough for the process of the present invention if a diffusion barrier layer can be formed upon the formation of an Al-diffused corrosion-resistant layer by heat treatment, and it is of no significance where the source of a component to be supplied to the diffusion barrier layer is. After Al diffusion treatment, the thickness of a diffusion barrier layer is generally 3 to 20 μm, preferably 5 to 10 μm, and the thickness of an Al-diffused corrosion-resistant layer is generally 10 to 50 μm, preferably 15 to 30 μm. The method of FIG. 3 corresponds to the above process 1, and the method of FIG. 4 corresponds to the above process 6.

Table 4 below shows exemplary compositions of a diffusion barrier layer and an Al-diffused corrosion-resistant layer as formed by each of the above processes.

TABLE 4

| | Composition (atomic %) | |
|---|---|---|
| Process | Diffusion barrier layer | Al-diffused corrosion-resistant layer |
| 1 | Ni—30Re—30Cr—8W—1B | Ni—50Al |
| 2 | Ni—30Re—20Cr—8W—1B | |
| 3 | Ni—25Re—20Cr—7W—1B | |
| 4 | Ni—30Re—30Cr—1B | |

TABLE 4-continued

| | Composition (atomic %) | |
|---|---|---|
| Process | Diffusion barrier layer | Al-diffused corrosion-resistant layer |
| 5 | Ni—25Re—20Cr—1B | |
| 6 | Ni—25Re—20Cr—10W—1B | Ni—50Al—10W |
| 7 | Ni—30Re—20Cr—8W—1B | Ni—50Al |
| 8 | Ni—30Re—30Cr—8W—1B | |
| 9 | Ni—30Re—20Cr—8W—1B | |

Other preferable high-temperature apparatus members to which the present invention can be advantageously applied include a rotor blade or a stator vane of a gas turbine as shown in FIGS. 8 through 11. Such a member having a protective coating can be produced in substantially the same manner as described above, and hence a description thereof is herein omitted.

What is claimed is:

1. An electroless plating bath for forming a Ni—Re—B alloy, containing not less than 50 at % of Re, on a substrate by electroless plating, said bath having a pH of 6 to 8 and comprising a metal supply source component containing $Ni^{2+}$ and $ReO_4^-$ at an equal equivalent in the range of 0.01 to 0.5 mol/L, a complexing agent component containing citric acid and at least one other organic acid, the molar concentration ratio of citric acid to the sum of $Ni^{2+}$ and $ReO_4^-$ being 1/20 to 1/5 and the molar concentration ratio of the total organic acid of said citric acid and said at least one other organic acid to the sum of $Ni^{2+}$ and $ReO_4^-$ being 1/2 to 10, and a reducing agent component containing dimethylamine-borane, the molar concentration ratio of dimethylamine-borane to the sum of $Ni^{2+}$ and $ReO4^-$ being 1/4 to 2.

2. The electroless plating bath according to claim 1, wherein said at least one other organic acid is an organic acid having a weaker complexing power for Re than citric acid.

3. The electroless plating bath according to claim 2, wherein the organic acid having a weaker complexing power for Re than citric acid is at least one of succinic acid, malic acid, lactic acid and glycine.

* * * * *